United States Patent [19]

Wolff

[11] 4,383,687

[45] May 17, 1983

[54] REFLECTING DEVICE FOR GOLF TRAINING OR ANY OTHER SPORT USING A BALL STRIKING STAFF

[76] Inventor: Claude Wolff, 33, rue Saint-James, 92200 Neuilly-sur-Seine, France

[21] Appl. No.: 325,938

[22] Filed: Nov. 30, 1981

[51] Int. Cl.[3] ..... A63B 69/36

[52] U.S. Cl. ..... 273/35 A; 350/293

[58] Field of Search ..... 350/288, 293, 238, 239; 273/35 A, 26 A, 183 E

[56] References Cited

U.S. PATENT DOCUMENTS

| | | | |
|---|---|---|---|
| D. 198,459 | 6/1964 | Blythe | 273/35 A X |
| 1,983,439 | 12/1934 | De Vore | 350/238 |
| 3,110,495 | 11/1963 | Carter | 350/293 X |
| 3,917,278 | 11/1975 | Steinman | 273/35 A X |

FOREIGN PATENT DOCUMENTS

| | | | |
|---|---|---|---|
| 1258018 | 12/1971 | United Kingdom | 273/35 A |

*Primary Examiner*—George J. Marlo

*Attorney, Agent, or Firm*—Sheridan Neimark; Karl W. Flocks

[57] ABSTRACT

A reflecting device for use in golf training comprises a carpet on which an orientable flap is hinged to pivot about a horizontal axis, the flap carrying a convex mirror. In two embodiments, a pivotally mounted strut is connected to the rear of the mirror, and the lower end of the strut is adapted to be held in slots or notches of a rack to hold the mirror at different inclinations. In a third embodiment, the mirror is held in adjusted positions by a hinged foot secured to the base of the mirror and locatable in any of a series of holes. The above mentioned slots, notches and holes provide spaced apart locations for adjusting the mirror to preset inclinations relative the different lengths of golf clubs. In using the reflecting device, the golfer views himself while addressing a golf ball positioned on the carpet in front of the convex mirror.

5 Claims, 4 Drawing Figures

REFLECTING DEVICE FOR GOLF TRAINING OR ANY OTHER SPORT USING A BALL STRIKING STAFF

The invention relates to a reflecting device for golf training or any other sport using a ball striking staff such as club, cane, crook, bat or mallet utilized for example in cricket, baseball, hockey, polo, crocket sports or games, etc.

There is known a reflecting device of this type consisting of a convex mirror having any orientation. The drawbacks of such device are that modifications in the inclination of such a mirror are overcome with difficulty; imposed rotations about a horizontal axis can be effected only by trial and error; unavoidable spurious rotations about a vertical axis can also be corrected by trial and error unless the player wishing to observe and correct his body's behaviour and motions moves around to be exactly in front of the mirror. Such a reflecting device requires significant time of adjustment for each new position, the presence of a partner for effecting such adjustment if the player holds his position, or a supplementary period of time as required for the player to return to his marks after modification of the inclination with respect to the vertical of the convex mirror. In case of golf playing, the player has actually at his disposal various clubs of different lengths and it is to be understood that the greater the club and arm distance, due to a longer club, the more the inclination of the mirror must approach the vertical, with the marks on the ground being obviously more remote from the mirror to take into account the increase in the club and arm distance.

The invention takes this requirement into account while remedying the above-mentioned drawbacks of the known device. Its object is a reflecting device for golf training or any other sport practiced with a ball striking staff comprising a variable inclination convex mirror, wherein the inclinations are effected about an axis of fixed horizontal direction and are preset as a function of the various lengths of the ball striking staff.

The change of inclination is obtained obviously after having indicated one's marks on the ground by moving off to effect the change imposed upon according to the presetting and then return to the indicated marks.

The change in inclination can be obtained by acting remotely upon the mirror for example by means of the club itself.

According to one form of embodiment, the mirror is orientable about an axis of fixed horizontal direction, said mirror being considered as having a tangency point with said axis.

The mirror is orientable to such tangency point which is fixed.

The mirror is orientable to such tangency point which is movable.

In both cases a strut holds the mirror at the selected inclination.

In the first case, the strut is moved to take a location corresponding to a given inclination.

In the second case, the tangency point of the mirror is moved to take a location corresponding to a given inclination.

It will be understood that differing diameters and convexities of the mirror can be provided depending on the height or height range of players for whom the device is intended.

Other characteristics and advantages of this invention will appear from the following description which is made in the light of the attached drawings in which.

Figure 1:
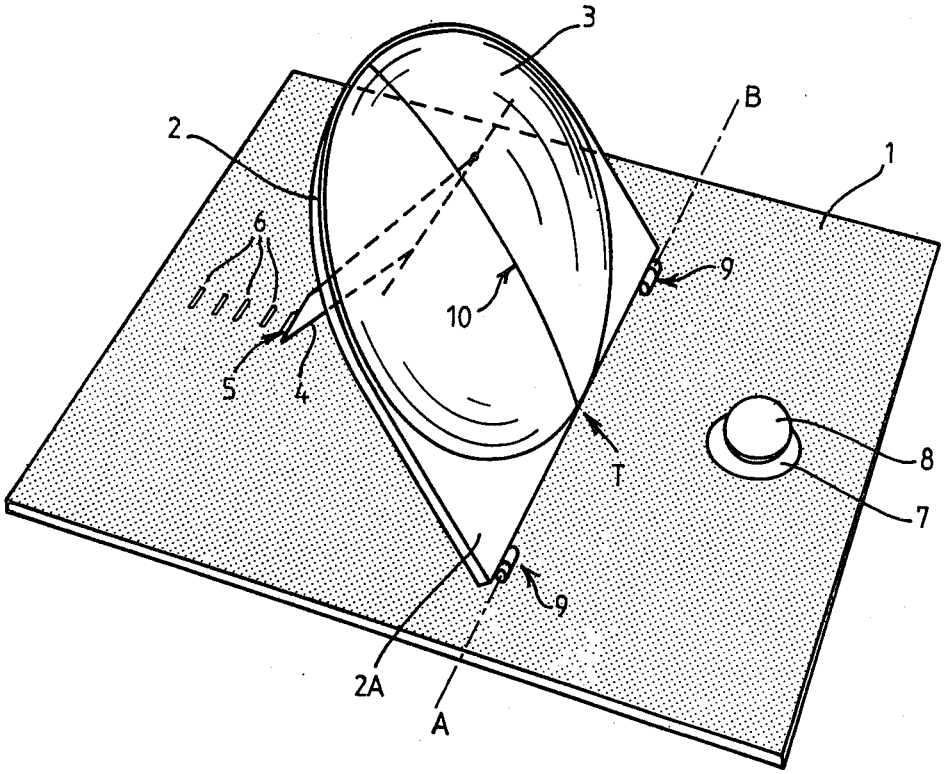
FIG. 1 is a perspective view of a form of embodiment of a device according to the invention.

The device such as shown in FIG. 1 comprises a carpet 1 on which an orientable flap 2 is hingedly connected according to a horizontally directed fixed geometric axis, said flap carrying the convex mirror 3.

The inclinations of the flap and therefore of the mirror are preset to each correspond to one length of club and a movable strut 4 holds the flap and mirror assembly in each of the preset positions, a bight portion 5 of the strut being capable of penetrating as many slots 6 as there are preset inclinations. Each slot can be identified by a specific sign, for example, a number corresponding to a length of club.

A tee 7 can be provided on the carpet in front of the mirror at an appropriate distance with respect to the mirror.

In the form of embodiment represented the mirror has a point of tangency T with the geometric axis A–B such that the mirror can reflect a complete image or as complete an image as possible, of the assembly formed by the player, the club and the ball 8.

The flap 2 is hingedly connected to the carpet 1 according to the axis A–B by two hinge means 9.

On the mirror 3 there can be drawn a vertical line 10 on which the player aligns the vertical axis of his body so as to be able to observe his attitude and motions with respect to such line 10.

The flap 2 can be provided with a surrounding 2A which can be coated with a coloured stuff to concentrate the player's attention to the flap and mirror assembly.

The attractive colour of the surrounding 2A can be replaced with an electric lamp disposed in the middle of the mirror or any other location on the latter, the flap or the carpet, such lamp then illuminating continuously or intermittently. Such arrangement may for example permit improvement of the immobility of the golfer's head during the back swing (pivoting of the body to the right hand side).

Figure 2:
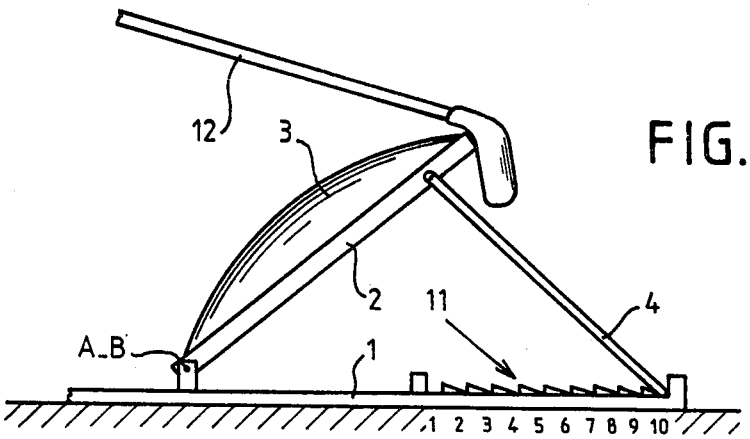
FIGS. 2 and 3 are side elevational views of another form of embodiment of the invention.
Figure 3:
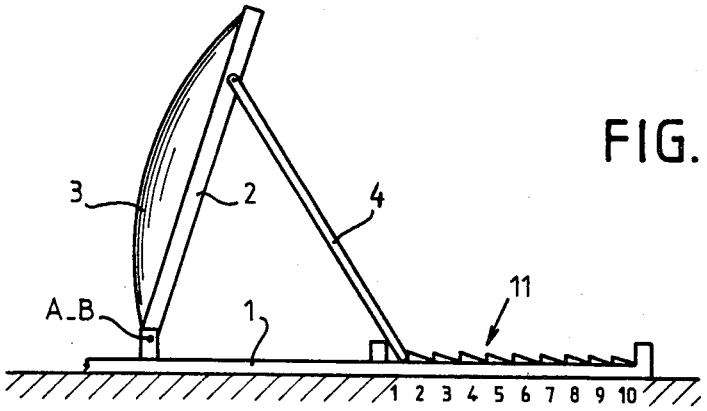

In the form of embodiment shown in FIGS. 2 and 3, the strut 4 cooperates with a rack 11 mounted on the carpet 1, with each hollow space in the rack corresponding to a preset inclination.

Variation in the inclination can be effected at a distance by using the club 12 itself to change the preset inclination, in that the golfer draws the flap and mirror assembly to himself by means of the club.

FIG. 3 shows the flap and mirror assembly in a position which is as close as possible to the vertical.

Figure 4:
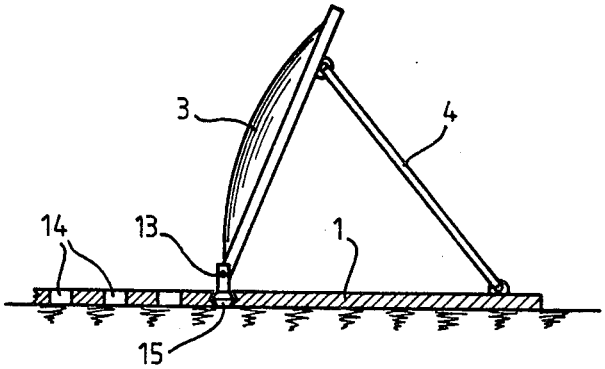
FIG. 4 is a side elevational view of still a further form of embodiment of the invention.

In the form of embodiment shown in FIG. 4, an hinged foot 13 of the flap and mirror assembly can be moved off for insertion into one of the holes of a series of holes 14 formed in the carpet for this purpose and each corresponding to a preset inclination of the mirror. The foot 13 has a head portion 15 which penetrates one of the holes 14 by deforming it; the carpet 1 can then be made of plastic material. In this form of embodiment, the strut 4 has two fixed articulation points, one on the flap and the other on the carpet.

I claim:

1. A reflection device for golf training or any other sport practiced with ball striking staffs where the staffs can be of differing lengths comprising a carpet, a convex mirror adjustable to various angles of inclination resting on said carpet, an orientable flap carrying said mirror, hinge means to rotate said mirror about a horizontal axis connected to said orientable flap, movable means connected to said mirror to retain said mirror in each of a plurality of preset inclined positions, spaced location means identifiable of different settings and placements for said movable means relative to differing lengths of the ball striking staffs.

2. The reflection device of claim 1, further characterized by said spaced location means being slots in said carpet, and said movable means being a movable strut having a free end fitting to said slots.

3. The reflection device of claim 1, further characterized by said spaced location means including a rack having hollow spaces forming the different settings and placements for said movable means, and said movable means having a movable strut having a free end fitting to said hollow spaces.

4. The reflector device of claim 1, further characterized by said spaced location means including a series of holes in said carpet corresponding to the different settings and placements for differing lengths of the ball striking staffs, and said movable means including a hinged strut connected to said mirror and a hinged foot secured to the base of said flap capable of occupying one of said series of holes.

5. The reflector device of claim 1, further characterized by said mirror having a point of tangency with the horizontal axis about which said mirror is rotated by said hinge means.

* * * * *